US006720718B2

(12) United States Patent
Trent et al.

(10) Patent No.: US 6,720,718 B2
(45) Date of Patent: Apr. 13, 2004

(54) THIN WALLED LAMP WITH TUNGSTEN HALOGEN CAPSULE AND PYROPHORIC FUSE

(75) Inventors: Carl Douglas Trent, Mount Sterling, KY (US); Jeffrey Paul Buschmann, Lexington, KY (US); Michael R. Kling, Lexington, KY (US)

(73) Assignee: Osram Sylvania Inc., Danvers, MA (US)

( * ) Notice: Subject to any disclaimer, the term of this patent is extended or adjusted under 35 U.S.C. 154(b) by 255 days.

(21) Appl. No.: 10/002,243

(22) Filed: Oct. 23, 2001

(65) Prior Publication Data

US 2003/0076026 A1 Apr. 24, 2003

(51) Int. Cl.[7] ..... H01J 5/50

(52) U.S. Cl. ..... 313/332; 313/580; 313/27; 315/56; 315/73; 315/74

(58) Field of Search ..... 313/332, 27, 580, 313/25, 26, 567, 569, 578; 362/21; 315/56, 58, 73, 74, 46, 106, 108; 337/401, 413, 416; 445/27; 439/181

(56) References Cited

U.S. PATENT DOCUMENTS 4,195,251 A * 3/1980 Bamberg ..... 315/73
4,362,969 A * 12/1982 Rothwell et al. ..... 315/73
6,577,065 B2 * 6/2003 Kling ..... 315/56

FOREIGN PATENT DOCUMENTS

NL WO 01/13406 A1 * 2/2001 ..... H01J/61/50

* cited by examiner

*Primary Examiner*—Edward J. Glick
*Assistant Examiner*—Elizabeth Gemmell
(74) *Attorney, Agent, or Firm*—William E. Meyer

(57) ABSTRACT

An efficient and safe lamp with a tungsten halogen capsule may be formed by using a two stage pyrophoric fuse as part of the electrical path to the capsule. The thin walled lamp with tungsten halogen capsule and two stage pyrophoric fuse yields a more efficient, less expensive and yet still safe tungsten halogen lamp. The thin walled lamp with tungsten halogen capsule and pyrophoric fuse provides a safe, thin walled outer envelope tungsten halogen lamp, provide a lamp with an oxygen sensitive fuse operable in low wattage lamps, provides a method manufacturing a pyrophoric fuse sensitive to moderate temperatures, provides an inexpensive and practical, low wattage, thin walled tungsten halogen lamp with a pyrophoric fuse.

9 Claims, 4 Drawing Sheets

THIN WALLED LAMP WITH TUNGSTEN HALOGEN CAPSULE AND PYROPHORIC FUSE

TECHNICAL FIELD

The invention relates to electric lamps and particularly to tungsten halogen electric lamps. More particularly the invention is concerned with tungsten halogen lamps with safe electrical disconnects.

BACKGROUND ART

Ordinary incandescent lamps are commonly made with a tungsten filament in an inert atmosphere. If the outer envelope is accidentally broken, oxygen rushes into the low pressure cavity. The hot tungsten filament then oxidizes and fails. This happens very rapidly, perhaps in a tenth of a second. To increase the efficiency and life of tungsten filament lamps one may use a halogen fill. Tungsten halogen lamps, as they are then called, are operated at significantly higher temperatures. The lamp capsule can then cause injury if not properly contained. To cope with hazards, tungsten halogen lamps have been made with outer jackets to create a greater heat dissipating surface and a containment vessel. One effective design uses a thick heavy (one eighth inch) walled outer envelope. The thickness of this outer wall is five or more times greater than that of a common incandescent lamp. The material cost of the thicker wall is apparent. The thicker wall also absorbs more of the light passing through it, and the weight can be objectionable in some lamp fixtures. There is a need to provide a thin outer walled tungsten halogen lamp.

The problem with a thin outer walled lamp system is that the outer envelope may break, while the inner envelope remains intact. The inner capsule then continues to operate, generating its normal heat. The broken outer capsule situation is then seen by some to pose a possible burn or fire hazard. A known way to extinguish the inner lamp is to use an electrical interrupt system responsive to the failure of the outer envelope. Such electrical interrupt systems have used mechanical or pressure based switches to cut the power to the inner capsule, on the fracture of the outer envelope. These mechanical systems are generally seen to be too expensive to be economically viable in the low wattage lamp market. An alternative method uses a fuse like system, so that when the outer envelope breaks, a fuse burns and thereby electrically disconnects the inner lamp capsule. Internal fused lamps have been used in high wattage discharge lamps where the fuse is sufficiently hot to ignite on contact with air. Low wattage lamps have been found to not generate sufficient heat to ignite the fuse. Additionally, actual construction of fused lamps can be impractical on large scale as welding the fuse in place can ignite the fuse. To avoid this one could use an inert assembly atmosphere, but that would be costly and would slow assembly. There is then a need for a lamp structure and a method of assembling it that enables a safe, thin outer walled tungsten halogen lamp.

U.S. Pat. No. 4,192,5,251 shows a high intensity arc discharge lamp that has an arc tube the emission of which includes some harmful UV radiation. An outer envelope surrounds the arc tube and substantially blocks the harmful UV radiation. The lamp includes a means to render the arc tube inoperative when the outer envelope becomes cracked or punctured sufficiently to admit air. The means includes a pyrophoric material to initiate combustion of a current carrying portion of the lamp circuit.

It is an object of the invention is to enable a safe, thin walled outer envelope tungsten halogen lamp.

It is an object of the invention is to provide a lamp with an oxygen sensitive fuse operable in low wattage lamps.

It is an object of the invention is to provide a method of manufacturing a pyrophoric fuse sensitive to moderate temperatures.

It is an object of the invention is to provide an inexpensive and practical, low wattage, thin walled tungsten halogen lamp with a pyrophoric fuse.

It is an object of the invention is to provide an inexpensive and practical, low wattage, thin walled tungsten halogen lamp with a pyrophoric fuse that is extinguished in five seconds or less on fracture of the outer envelope.

DISCLOSURE OF THE INVENTION

An incandescent lamp may be made with a sealed, light transmissive tungsten halogen capsule receiving electrical power through a first lead and a second lead. At least one of the leads is coupled in series with an oxidizable electrical connection having a first pyrophoric stage ignitable at a first temperature and a second pyrophoric stage ignitable at a second temperature higher than the first temperature. The first pyrophoric stage is positioned sufficiently near the second pyrophoric stage to transmit sufficient heat from the first pyrophoric stage during pyrophoric ignition to the second stage to cause ignition of the second stage. A sealed light transmissive outer envelope encloses the capsule, the oxidizable connection and an inert atmosphere around the connection. An electrical connection for the tungsten halogen capsule is also provided.

BEST MODE FOR CARRYING OUT THE INVENTION

Figure 1:
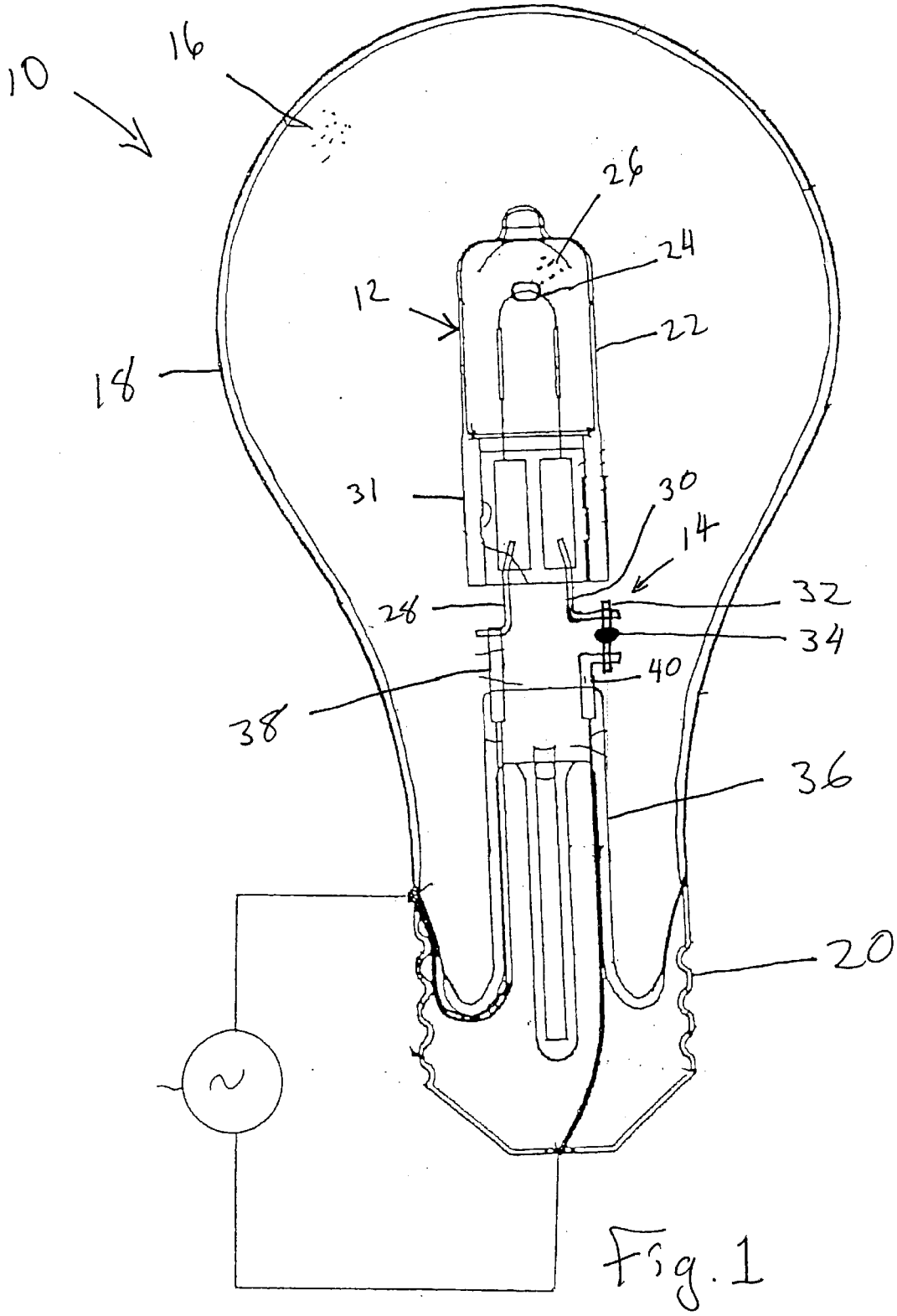
FIG. 1 shows a cross sectional view of a preferred embodiment of a thin walled lamp with tungsten halogen capsule and pyrophoric fuse.

FIG. 1 shows a preferred embodiment of a thin walled lamp 10 with tungsten halogen capsule 12 and a pyrophoric connection 14. Like reference numbers designate like or corresponding parts throughout the drawings and specification. The thin walled lamp 10 includes a tungsten halogen capsule 12 electrically coupled by a pyrophoric connection 14 which is enclosed in an inert atmosphere 16 contained in a light transmissive, thin walled outer envelope 18 mechanically supported by a base 20. The thin walled outer envelope 18 may be made from a soft glass such as a soda or lime glass with a wall thickness of 1.0 millimeter or less.

The tungsten halogen capsule 12 may be made out of light transmissive material such as quartz or hard glass. Quartz is preferred. While hard glasses have been used in tungsten halogen capsules, hard glass has been found to be less strong and less able to retain the interior pressure. Quartz is stronger. The inner capsule 12 has the general form of a sealed tube with electrical leads passing from the exterior to the interior of the tube. The preferred tungsten halogen capsule 12 has a light transmissive inner envelope 22 defining an enclosed volume including a tungsten filament 24 surrounded by a halogen fill 26. The tungsten halogen fill 26 may be any one of numerous fills known in the art. The filament 24 is electrically coupled through the inner envelope 22 by a first lead 28, and a second lead 30 extending through a press seal 31. The preferred first lead 28 and the second lead 30 are made from molybdenum wire. The tungsten filament 24 may be supported from extensions of the leads 28, 30 inside the capsule 12.

Figure 2:
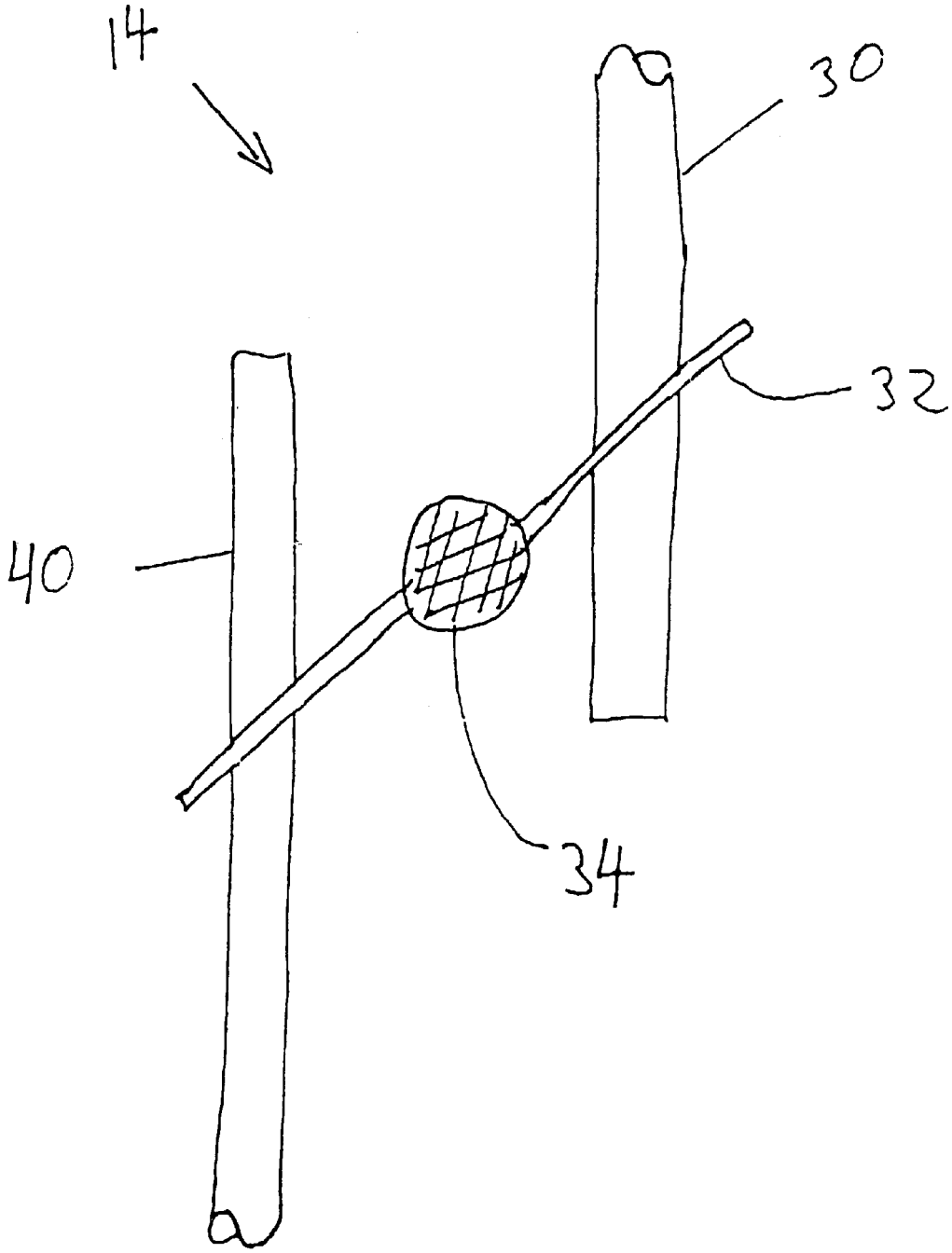
FIG. 2 shows a cross sectional view of a pyrophoric connection.

FIG. 2 shows a pyrophoric connection 14. The pyrophoric connection 14 may be made out of an oxidizable and electrically conductive link to have the general form of an elongated wire, coil or ribbon. The tungsten halogen capsule 12 is supplied electricity through the pyrophoric connection 14. For example the pyrophoric connection 14 may be coupled in series with one of the capsule leads 28, 30. The pyrophoric connection 14 has a moderate to high temperature fuse wire 32, and a low temperature igniter 34. The fuse wire 32 may be round, but ribbon, bar, coiled or other shapes are acceptable. In the preferred embodiment the fuse is shaped as a coil 50 in FIG. 3. The relatively higher temperature fuse wire 32 may be formed from any of a number of known high temperature, electrically conductive pyrophoric fuse materials. These may include a number of metal or metal alloys such as aluminum, hafnium, niobium, tantalum, tungsten or zirconium wire that can be formed so as to rapidly oxidize and cause mechanical separation of the wire line. The high temperature fuse wire 32 may be welded to span the leads 30, 40. The low temperature igniter 34 is then painted, dripped or otherwise attached to the fuse wire 32.

Figure 3:
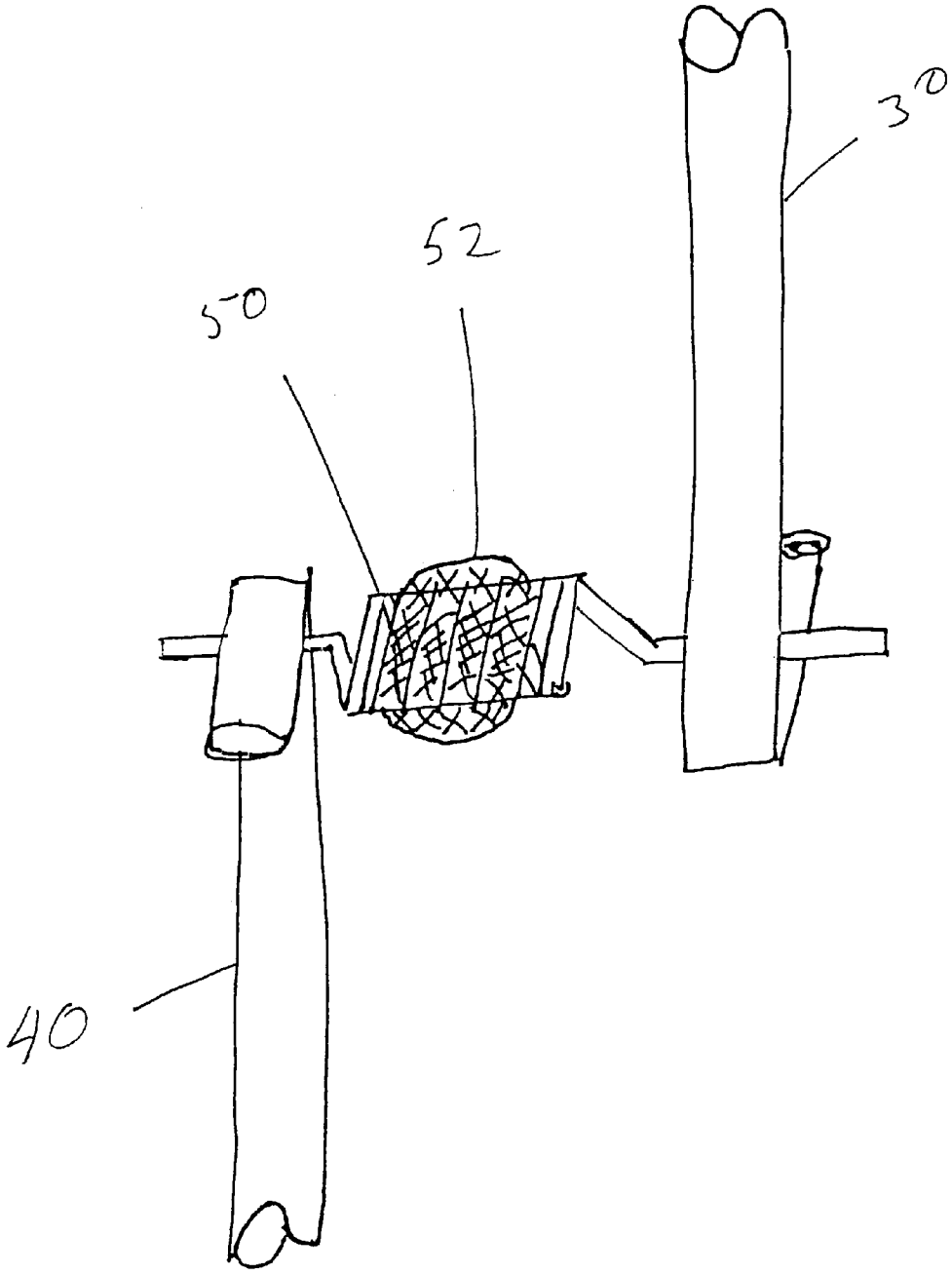
FIG. 3 shows a cross sectional view of a pyrophoric coil connection.

FIG. 3 shows a cross sectional view of a pyrophoric coil connection. Instead of using straight wire for the higher temperature portion of the pyrophoric fuse connection 14, a coil 50 is believed to be better. The legs of the coil may be welded or crimped in bends in the lead ends 30, 40. The coil 50 is then internally loaded with a low temperature pyrophoric material. For example, the coil may be dabbed with a slurry of the lower temperature pyrophoric material 52 that is then wicked in and around the coil turns. The coil 50 is believed to run more current relative to a straight wire at the same temperature, and also acts to trap and retain the low temperature pyrophoric material 52. The Applicants found that a coiled zirconium fuse performed much better than a straight wire. The coiling allows a higher wire temperature at a given wire diameter. Achieving the required ignition temperature with a straight wire requires smaller wire diameter, which is more susceptible to overheating and failure due to high inrush current at turn-on. The coiled wire fuse also provides a good support for the lower temperature material 52. The applied paste or slurry naturally wicks into the coil body rather than flowing to the ends, where lead wires act as heat sinks preventing the pyrophoric from reaching ignition temperature. The coil 50 also retains the lower temperature pyrophoric material 52 better than a straight wire. The zirconium fuse coil can be either welded or clamped into a capsule mount. The preferred fuse wire construction is a zirconium coil with at least 4 turns in the body and at least 1.0 millimeter leg length. The wire diameter is otherwise sized according to the lamp wattage. Coil pitch is determined by the operating temperature in air.

The preferred pyrophoric connection 14 is designed to have a minimal affect on the electrical efficiency of the lamp. Zirconium was compared to nickel and the power loss in a 12.7 by 0.127 by 0.0254 millimeter (0.5 inch by 0.005 by 0.001 inch) piece of zirconium foil was found to be about 0.25 watts which is considered acceptable. The high temperature fuse wire 32 is chosen to have an ignition temperature sufficiently high that the fuse wire 32 may be conveniently and securely attached in series between one of the capsule leads 28, 30 and one of the stem leads 38, 40.

Figure 4:
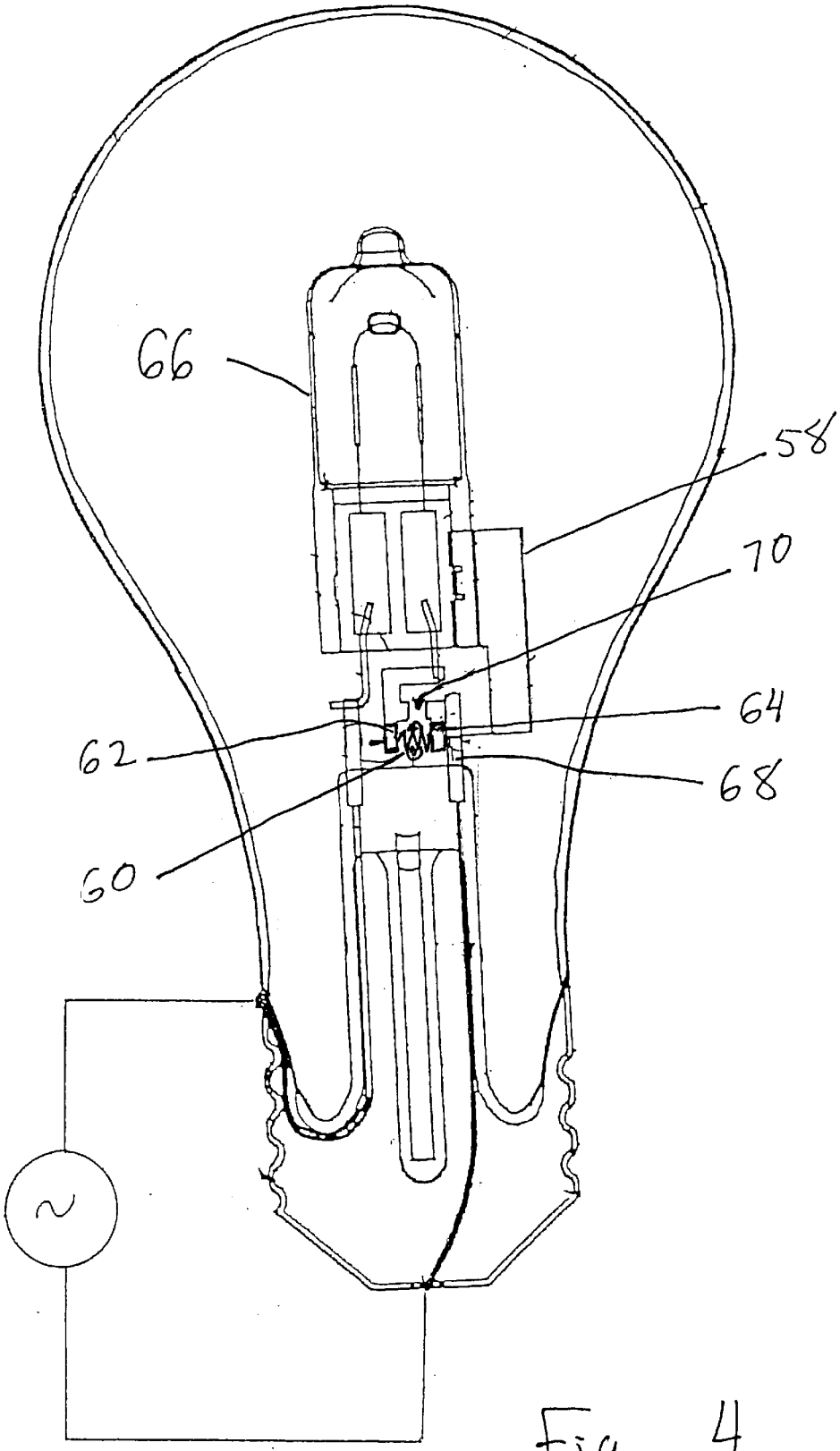
FIG. 4 shows a cross sectional view of a preferred embodiment of a thin walled lamp with tungsten halogen capsule and pyrophoric fuse held in a clip assembly.

One attachment method is to weld fuse wire 32 to a capsule lead 28, or 30, but welding in air, or letting the hot weld be exposed to air may result in premature ignition of the fuse wire 32. A preferred alternative method of assembly is to couple the fuse to a clip. FIG. 4 shows a cross sectional view of a preferred embodiment of a thin walled lamp with tungsten halogen capsule and pyrophoric fuse held in a clip assembly 58. The coated coil fuse 60 is positioned between two clamp arms 62, 64 that are then pressed shut to trap the coil legs. The clip assembly 58 is then coupled the inner lamp capsule 66 and the base lead 68. Once the inner capsule 66 is held in place, a bridge piece 70 (shown as removed) in the clip assembly 58 is removed, for example by laser cutting, to force the electrical connection to pass through the coated coil fuse 60.

Pyrophoric materials can be assembled in an inert gas such as argon or nitrogen, and then left to cool in the inert atmosphere sufficiently long to avoid ignition. These requirements can be cumbersome steps in high speed manufacturing. The preferred fuse wire 32 ignites at a temperature generally above the range of ordinary assembly methods. The high temperature fuse wire 32 material may then not ignite in the temperature range achieved under normal lamp operation, even if exposed to air or oxygen. The actual ignition temperature of zirconium depends on particle size or wire diameter and may range from 25 degrees Celsius for very fine powder to quite high temperatures for massive quantities. The preferred high temperature fuse wire 32 is zirconium wire with an ignition temperature of about 350 degrees Celsius.

Positioned on or near the high temperature pyrophoric fuse wire 32 is a low temperature igniter 34. The low temperature igniter 34 is chosen to ignite if exposed to air or oxygen in the normal operating temperature range of the lamp. In the event the outer envelope 18 is then fractured, the relatively lower temperature igniter 34 ignites, due to the lamp heat and the in rush of air, including oxygen. The low temperature igniter is heated by a combination of radiation, thermal convection, and thermal conduction from capsule and also by the resistive heating of lamp current flowing through the fuse wire. The resistive heating assists ignition of the zirconium fuse wire. The preferred low temperature igniter 34 is an oxidizable paste of powdered iron, aluminum, boron and an acrylic binder. The actual ignition temperature of the paste may be tuned by adjusting the proportions of the paste. The preferred paste has an approximate weight percent composition of 84% iron, 5% aluminum, 10% boron and 1% acrylic binder. The acrylic binder was sometimes found to decompose at the required operating temperature and the igniter powder dropped from the fuse wire over life. Degradation products could then react with zirconium wire or igniter powder passivating the surfaces. Caging the lower temperature igniter material in the coil is believed to limit these results.

The mass of the low temperature igniter 34 is chosen to generate sufficient heat during its initial ignition to bring the adjacent high temperature fuse wire 32 to or above its ignition temperature. The generated temperature, the mass of the low temperature igniter 34 and the distance of the low temperature igniter 34 from the high temperature fuse wire 32 may all then be balanced one against the other. In the preferred embodiment, the high temperature fuse wire 32 is in direct contact with the low temperature igniter 34, so the offset distance is zero. In the preferred embodiment the fuse wire 32 is a coil, and the low temperature igniter 34 is applied as a drip that saturates the coil. The preferred low temperature igniter 34 is chosen to ignite at about 150 degrees Celsius, and generate a much higher temperature on ignition, one greater than the ignition temperature of the high temperature fuse wire 32. The preferred high temperature fuse wire 32 is chosen to have an ignition temperature of about 350 degrees Celsius. When the low temperature igniter 34 is hot, as when exposed to the normal radiation of the nearby lamp capsule 12, and exposed to air or oxygen, as when the outer envelop 18 is fractured, the relatively lower temperature igniter 34 rapidly ignites and burns, generating sufficient heat to ignite the relatively higher temperature fuse wire 32. The high temperature fuse wire 32 then ignites and bums severing the electrical connection 14 to the lamp capsule 12.

The sealed outer envelope may be made out of thin walled soda or lime glass to have the general form of a typical lamp bulb with a thread base and a glass bulb. The preferred outer envelope is about 0.635 millimeter (0.025 inch) thick. The outer envelope may include a glass stem 36 with a first stem lead 38 and a second stem lead 40 sealed through the stem 36 to be exposed inside the volume enclosed by the outer envelope 18. The tungsten halogen capsule 12 is enclosed in the sealed outer envelope 18. One of the leads 28, 30 of the lamp capsule 12 may be used to position and support the lamp capsule 12 in the outer envelope 18. One support method is to bind the capsule 12 along the press seal 31 to one of the stem leads 38. The first capsule lead 28 is then welded to the first stem lead 38. This provides one of the electrical connections for the capsule 12, and mechanical support for the capsule 12. The high temperature pyrophoric fuse wire 32 is then welded to the second capsule lead 30, and welded to the second stem lead 40 to form the second electrical connection between the lamp capsule 12 and stem leads 30, 40. The low temperature igniter 34 is then attached to or otherwise placed sufficiently near the high temperature fuse wire 32 such that the heat generated by the low temperature igniter 34 ignites the high temperature fuse wire 32. The attachment may be by any convenient method. The preferred attachment method is to paint or drip coat the high temperature fuse wire 32 with the low temperature igniter 34. The capsule 12 and stem 36 assembly is then sealed to the outer envelope 18, and the enclosed volume is filled with an inert atmosphere 16. The preferred fill 16 is low pressure helium (about 600 torr). Helium tends to cool the fuse assembly 14 during lamp operation thereby increasing conductivity and overall electrical efficiency. Argon has also been used successfully as a fill gas. The outer envelope 18 and stem 36 assembly is then attached, as is known in the art, to a base 20. The preferred base 20 is a threaded medium base, but may be any of the known base types. It is understood that other capsule support systems may be used to hold and position the lamp capsule 12 in the outer envelope 18, and that other basing designs maybe used. The preferred stem leads 38, 40 are nickel plated iron. The preferred coupling between the first capsule lead 28 is to weld the first capsule lead 28 to the first stem lead 38. The preferred stem lead 38 electrically couples to a threaded side tap in a threaded base 20. The preferred second lead 40 electrical connects to the center tap of the threaded base 20.

In the preferred capsule, the filament legs extend into the press region to reduce potential arcing across the filament ends. A glass dimple is used to support the filament instead of the typical 1.016 millimeter (0.040 inch) molybdenum leads. The quartz halogen design reduces the risk of containment failure in the event of a filament arc over. A test of 2890 forty (40) watt lamps of this design was preformed by applying excessively high current to the lamp leads and no containment failures occurred.

In a working example some of the dimensions were approximately as follows: The tungsten halogen capsule was made of light transmissive material such as quartz or hard glass, and had an inner envelope, a first lead, a second lead, a tungsten filament, a tungsten halogen fill. The quartz tube had wall thickness of 1.1 millimeters (0.043 inch); a body length of length of 40.0 millimeters (1.6 inches) and an internal diameter of 11.1 millimeters (0.44 inch). The pyrophoric connection was made of oxidizable and conductive zirconium wire with an ignition temperature of about 350 degrees Celsius, a length of 12.5 millimeters (0.5 inch), and a diameter of 0.11 millimeters (0.0043 inch). A preferred fuse design for a 40 watt lamp is 0.127 millimeter (0.005 inch) diameter zirconium wire formed into a coil with 2.0 millimeter legs, 0.3302 millimeter (0.013 inch) mandrel, and 150% pitch with 1.0 milligram of low temperature igniter and binder applied to the coil. Each lamp wattage is expected to have different fuse size parameters.

A more efficient, less expensive and safe tungsten halogen lamp may then be formed by performing the steps of 1) forming a tungsten halogen capsule, 2) coupling a first capsule lead to a first lamp base lead, 3) a high temperature pyrophoric connection between a second capsule lead and a second base lead, 4) positioning a low temperature igniter adjacent the high temperature igniter, 5) positioning an inert atmosphere around the high and low temperature igniters, and 6) enclosing the lamp capsule in a sealed lamp envelope.

At the required operating temperature, the zirconium wire can react with gaseous contaminants in the outer jacket and become brittle. Also, the pyrophoric igniter can be passivated with repeated cycling between room temperature and operating temperature. A helium intermediate fill gas can also benefit the zirconium fuse and pyrophoric igniter construction by substantially reducing the operating temperature of wire and igniter. A lower temperature may eliminate acrylic binder degradation and premature reaction of pyrophoric powder and zirconium wire with trace contaminants in the fill gas. The surrounding helium keeps the operating temperature of the fuse lower and allows a rapid increase to ignition temperature when the outer jacket is broken and the helium fill escapes.

The disclosed operating conditions dimensions, configurations and embodiments are as examples only, and other suitable configurations and relations may be used to implement the invention. While there have been shown and described what are at present considered to be the preferred embodiments of the invention, it will be apparent to those skilled in the art that various changes and modifications can be made herein without departing from the scope of the invention defined by the appended claims.

What is claimed is:

1. An incandescent lamp comprising:

a) a sealed, light transmissive tungsten halogen capsule receiving electrical power through a first lead and a second lead;

b) at least one of the leads being coupled in series with an oxidizable electrical connection having a first pyrophoric stage ignitable at a first temperature and a second pyrophoric stage ignitable at a second temperature higher than the first temperature, the first pyrophoric stage positioned sufficiently near the second pyrophoric stage to transmit sufficient heat from the first pyrophoric stage during pyrophoric ignition to the second stage to cause ignition of the second stage; and c) a sealed light transmissive outer envelope enclosing the capsule, the oxidizable connection and an inert atmosphere around the connection, and providing electrical connection for the tungsten halogen capsule and wherein the second pyrophoric stage is a zirconium wire.

2. An incandescent lamp comprising:

a) a sealed, light transmissive tungsten halogen capsule receiving electrical power through a first lead and a second lead;

b) at least one of the leads being coupled in series with an oxidizable electrical connection having a first pyrophoric stage ignitable at a first temperature and a second pyrophoric stage ignitable at a second temperature higher than the first temperature, the first pyrophoric stage positioned sufficiently near the second pyrophoric stage to transmit sufficient heat from the first pyrophoric stage during pyrophoric ignition to the second stage to cause ignition of the second stage; and c) a sealed light transmissive outer envelope enclosing the capsule, the oxidizable connection and an inert atmosphere around the connection, and providing electrical connection for the tungsten halogen capsule wherein the first pyrophoric stage is an oxidizable coating at least partially covering the second pyrophoric stage; and wherein the oxidizable coating is a combination of metals and a binder.

3. An incandescent lamp comprising:

a) a sealed, light transmissive tungsten halogen capsule receiving electrical power through a first lead and a second lead;

b) at least one of the leads being coupled in series with an oxidizable electrical connection having a first pyrophoric stage ignitable at a first temperature and a second pyrophoric stage ignitable at a second temperature higher than the first temperature, the first pyrophoric stage positioned sufficiently near the second pyrophoric stage to transmit sufficient heat from the first pyrophoric stage during pyrophoric ignition to the second stage to cause ignition of the second stage; and c) a sealed light transmissive outer envelope enclosing the capsule, the oxidizable connection and an inert atmosphere around the connection, and providing electrical connection for the tungsten halogen capsule wherein the first pyrophoric stage is an oxidizable coating at least partially covering the second pyrophoric stage; and wherein the coating includes iron.

4. An incandescent lamp comprising:

a) a sealed, light transmissive tungsten halogen capsule receiving electrical power through a first lead and a second lead;

b) at least one of the leads being coupled in series with an oxidizable electrical connection having a first pyrophoric stage ignitable at a first temperature and a second pyrophoric stage ignitable at a second temperature higher than the first temperature, the first pyrophoric stage positioned sufficiently near the second pyrophoric stage to transmit sufficient heat from the first pyrophoric stage during pyrophoric ignition to the second stage to cause ignition of the second stage; and c) a sealed light transmissive outer envelope enclosing the capsule, the oxidizable connection and an inert atmosphere around the connection, and providing electrical connection for the tungsten halogen capsule wherein the first pyrophoric stage is an oxidizable coating at least partially covering the second pyrophoric stage; and wherein the coating includes aluminum.

5. An incandescent lamp comprising:

a) a sealed, light transmissive tungsten halogen capsule receiving electrical power through a first lead and a second lead;

b) at least one of the leads being coupled in series with an oxidizable electrical connection having a first pyrophoric stage ignitable at a first temperature and a second pyrophoric stage ignitable at a second temperature higher than the first temperature, the first pyrophoric stage positioned sufficiently near the second pyrophoric stage to transmit sufficient heat from the first pyrophoric stage during pyrophoric ignition to the second stage to cause ignition of the second stage; and c) a sealed light transmissive outer envelope enclosing the capsule, the oxidizable connection and an inert atmosphere around the connection, and providing electrical connection for the tungsten halogen capsule wherein the first pyrophoric stage is an oxidizable coating at least partially covering the second pyrophoric stage; and wherein the coating includes boron.

6. An incondescent lamp comprising:

a) a sealed, light transmissive tungsten halogen capsule receiving electrical power through a first lead and a second lead;

b) at least one of the leads being coupled in series with an oxidizable electrical connection having a first pyrophoric stage ignitable at a first temperature and a second pyrophoric stage ignitable at a second temperature higher than the first temperature, the first pyrophoric stage positioned sufficiently near the second pyrophoric stage to transmit sufficient heat from the first pyrophoric stage during pyrophoric ignition to the second stage to cause ignition of the second stage; and c) a sealed light transmissive outer envelope enclosing the capsule, the oxidizable connection and an inert atmosphere around the connection, and providing electrical connection for the tungsten halogen capsule wherein the first pyrophoric stage is an oxidizable coating at least partially covering the second pyrophoric stage; and wherein the coating includes organic binder.

7. An incandescent lamp comprising:

a) a sealed, light transmissive tungsten halogen capsule receiving electrical power through a first lead and a second lead;

b) at least one of the leads being coupled in series with an oxidizable electrical connection having a first pyrophoric stage ignitable at a first temperature and a second pyrophoric stage ignitable at a second temperature higher than the first temperature, the first pyrophoric stage positioned sufficiently near the second pyrophoric stage to transmit sufficient heat from the first pyrophoric stage during pyrophoric ignition to the second stage to cause ignition of the second stage; and c) a sealed light transmissive outer envelope enclosing the capsule, the oxidizable connection and an inert atmosphere around the connection, and providing electrical connection for the tungsten halogen capsule wherein the first pyrophoric stage is an oxidizable coating at least partially covering the second pyrophoric stage; and wherein the coating includes an acrylic binder.

8. An incandescent lamp comprising:

a) a sealed, light transmissive tungsten halogen capsule receiving electrical power through a first lead and a second lead;

b) at least one of the leads being coupled in series with an oxidizable electrical connection having a first pyrophoric stage ignitable at a first temperature and a second pyrophoric stage ignitable at a second temperature higher than the first temperature, the first pyrophoric stage positioned sufficiently near the second pyrophoric stage to transmit sufficient heat from the first pyrophoric stage during pyrophoric ignition to the second stage to cause ignition of the second stage; and c) a sealed light transmissive outer envelope enclosing the capsule, the oxidizable connection and an inert atmosphere around the connection, and providing electrical connection for the tungsten halogen capsule wherein the first pyrophoric stage is an oxidizable coating at least partially covering the second pyrophoric stage; and wherein the coating includes iron, aluminum, boron, and an acrylic binder.

9. An incandescent lamp comprising:

a) a sealed, light transmissive tungsten halogen capsule receiving electrical power through a first lead and a second lead;

b) at least one of the leads being coupled in series with an oxidizable electrical connection having a first pyrophoric stage ignitable at a first temperature and a second pyrophoric stage ignitable at a second temperature higher than the first temperature, the first pyrophoric stage positioned sufficiently near the second pyrophoric stage to transmit sufficient heat from the first pyrophoric stage during pyrophoric ignition to the second stage to cause ignition of the second stage; and c) a sealed light transmissive outer envelope enclosing the capsule, the oxidizable connection and an inert atmosphere around the connection, and providing electrical connection for the tungsten halogen capsule wherein the first pyrophoric stage is an oxidizable coating at least partially covering the second pyrophoric stage; and wherein the coating includes by weight about 84% iron, 5% aluminum, 10% boron and 1% acrylic binder.

* * * * *